United States Patent [19]

Barkas

[11] Patent Number: 4,544,219

[45] Date of Patent: Oct. 1, 1985

[54] SHUTTERED ELECTRICAL RECEPTACLE

[75] Inventor: Emanuel E. Barkas, Branford, Conn.

[73] Assignee: Harvey Hubbell Incorporated, Orange, Conn.

[21] Appl. No.: 616,070

[22] Filed: Jun. 1, 1984

[51] Int. Cl.[4] ..... H01R 13/447

[52] U.S. Cl. ..... 339/40

[58] Field of Search ..... 339/40, 42

[56] References Cited

U.S. PATENT DOCUMENTS

| | | | |
|---|---|---|---|
| 2,155,925 | 4/1939 | Blinn | 173/323 |
| 2,336,218 | 12/1943 | Blinn | 173/323 |
| 2,500,474 | 3/1950 | Sperrazza | 200/51.09 |
| 2,528,014 | 10/1950 | Moses, Jr. et al. | 173/330 |
| 2,531,625 | 11/1950 | Hubbell | 200/51.09 |
| 2,540,496 | 2/1951 | Sperrazza | 200/51.09 |
| 2,545,536 | 3/1951 | Von Holtz | 173/330 |
| 2,553,837 | 5/1951 | Von Holtz | 173/330 |
| 2,701,347 | 2/1955 | Davidsson | 339/40 |
| 2,770,786 | 11/1956 | Chelton | 339/40 |
| 2,820,842 | 1/1958 | Meistrell | 174/67 |
| 2,826,652 | 3/1958 | Piplack | 200/51.09 |
| 3,238,492 | 3/1966 | Houston | 339/40 |
| 3,699,285 | 10/1972 | Leatherman | 200/51.09 |
| 3,736,547 | 5/1973 | Koenig | 339/14 |
| 3,775,726 | 11/1973 | Gress | 339/14 |
| 3,846,598 | 11/1974 | Mucsi | 200/51.09 |
| 3,909,566 | 9/1975 | Morrison et al. | 200/51.07 |
| 3,980,370 | 9/1976 | Gonzalez-Hernandez | 339/40 |
| 4,072,382 | 2/1978 | Reschke | 339/40 |
| 4,271,337 | 6/1981 | Barkas | 200/51.09 |
| 4,379,607 | 4/1983 | Bowden, Jr. | 339/40 |

FOREIGN PATENT DOCUMENTS

| | | | |
|---|---|---|---|
| 1283102 | 12/1961 | France | 339/40 |
| 508415 | 6/1939 | United Kingdom . | |

*Primary Examiner*—Joseph H. McGlynn
*Assistant Examiner*—Paula Austin
*Attorney, Agent, or Firm*—Jerry M. Presson; Walter C. Farley

[57] ABSTRACT

A shutter mechanism for an electrical receptacle includes two shutter members each of which has a cam surface under one blade slot of the receptacle face and a blocking member under the other blade slot. One of the blade slots is T-shaped to admit either a blade parallel with the first blade or a blade perpendicular thereto. The blocking member under that slot is split along the plane of the perpendicular blade forming a gap which is separable when that kind of blade is inserted. To prevent separation until two blades are simultaneously inserted, the separable portions have projections which are held together by arms of the other shutter member. The apparatus is usable with a plug also having a grounding blade.

20 Claims, 12 Drawing Figures

SHUTTERED ELECTRICAL RECEPTACLE

This invention relates to an improved shuttered electrical receptacle and, particularly, to such a receptacle in which substantially concurrent insertion of the plug blades is required for operation.

BACKGROUND OF THE INVENTION

There is a group of electrical receptacles which can be referred to as "protective" receptacles because some measure has been taken in the construction to protect children and others from harm if they should intentionally or inadvertently insert or attempt to insert an electrically conductive article into the electrically energized portions of the receptacle. Conventional receptacles, of course, have a nonconductive face portion with openings to receive plug blades. In normal use, the blades pass through the nonconductive space and are received by conductive female spring elements which are connected to line voltage. A child inserting, for example, a paper clip or the conductive portion of a toy into the energized spring elements can be seriously injured.

To avoid this danger, several different kinds of safety receptacles have been designed, and these fall into two general categories. One category is those receptacles which have internal switches and movable members between the faceplate and the female spring elements to operate the switches only when a predetermined number, type, or shape of blade elements is inserted concurrently. The purpose of devices of this type is to avoid energization of the internal conductive portions of the receptacle unless predetermined conditions exist, these conditions being those which would normally be present only when the appropriate plug or the like is inserted. Generally, insertion of an article is not inhibited; rather, the existence of voltage in the receptacle is controlled. Examples of devices of this type are found in U.S. Pat. Nos. 4,271,337, Barkas, and 2,500,474, Sperrazza, and the references cited therein.

Another category of protective receptacles can be referred to as "shuttered" receptacles, the principle of operation of this type being that insertion of anything other than the blades of an appropriate plug is inhibited by elements provided between the faceplate and the conductive elements. There is no effort to control the electrical energization of internal components; rather, access to those conductive elements is prevented except under a defined set of circumstances.

An example of a device of this type is found in U.S. Pat. No. 4,379,607. Bowden, Jr., and the references cited therein also provide examples of both the shuttered and switched types of electrical receptacles. Bowden is of particular interest because two relatively slideable members are provided behind the slots in the faceplate and in front of the terminals within the receptacle housing. The two members are identical, each having a cam surface and a blocking portion, the cam surfaces being positioned so that each one is contacted by a blade and is caused to move so that its blocking member unblocks the slot for the other blade. Thus, when the two blades are concurrently inserted, they act against the two cam surfaces and unblock each other's passageways.

While this structure appears to be quite suitable for its intended purpose, and while it does have the advantage of permitting the use of shuttering in a grounded plug and receptacle, the design is such that it can only be used with plugs having parallel blades such as type 1-15 P and 5-15 P.

As is well known, however, plugs and receptacles used in the home as well as in offices and other circumstances at the present time include configurations such as 5-20 P, 6-20 P and others in which the blades are perpendicular to each other rather than being parallel. The receptacles, such as 5-20 R, are configured to be able to receive either the 5-15 P or 5-20 P plugs. The structure of Bowden is simply not usable with configurations of this type, nor are the other shuttered and switched structures of the prior art.

BRIEF DESCRIPTION OF THE INVENTION

Accordingly, an object of the present invention is to provide a shuttered electrical receptacle structure in which movable bodies are positioned within the receptacle housing to obstruct the blade passageways but are movable when all of the blades are inserted to permit passage with blade orientations including parallel blades but also including other orientations.

A further object is to provide such a structure which is simple to produce with a minimum of components and which is reliable in operation.

Briefly described, the shutter mechanism of the present invention is intended for use in a receptacle of the type which has a faceplate with slots therethrough shaped and dimensioned to permit the passage of plug blades wherein the blades can be, but need not be, parallel with each other. The structure includes first and second relatively movable shutter members with spring means for urging these shutter members toward a normal location, in the absence of plug blades, which can be viewed as a rest position. The first shutter member includes a first blocking member having a surface lying in a position to block the path of one of the blades when the shutter members are in their normal location. The first shutter member also includes a first body having a first inclined cam surface lying in the path of the other blade which can be parallel with the first or perpendicular thereto, the cam surface facing away from the first blocking member. The first blocking member and the first body are substantially rigidly interconnected and the shutter member also includes first and second parallel arms which extend away from opposite ends of the first cam surface in the direction in which that cam surface faces. The second shutter member includes a second body having a second cam surface lying in the path of the second blade in its normal location and also lies partly in front of the blocking surface of the first member. The second shutter further includes third and fourth resilient, generally parallel arms extending away from opposite ends of the second body in a direction opposite the facing direction of the second cam surface, the arms having third and fourth bodies at their distal ends, the third and fourth bodies extending toward each other to form, together, a second blocking member which lies partly behind the first cam surface and in a position to block the path of the second blade, the third and fourth bodies meeting along a line perpendicuar with the plane containing the first blade. Third and fourth projections extend away from the third and fourth bodies and protrude between the first and second parallel arms to hold the third and fourth bodies together. When the first and second cam surfaces are contacted by the concurrent entry of plug blades to move the shutter members counter to the spring means so that the first and second blocking members move away from the blade paths, the first and second parallel arms are withdrawn from the third and fourth projections, the length thereof being selected so that the projections are released, permitting the third and fourth bodies to separate and admit a perpendicular blade therebetween.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

In discussing the present invention, it will be assumed that the reader is familiar with the various NEMA standard configurations for plugs and receptacles which are set forth in the National Electrical Code developed by the National Electrical Manufacturers Association. The present invention will be discussed in the context of receptacle configurations identified as 5-15 R and 5-20 R, with which the described embodiment of the invention can be used. It should be understood, however, that with suitable dimensional changes the concept of the invention may be applicable to other NEMA configurations.

Figure 1:
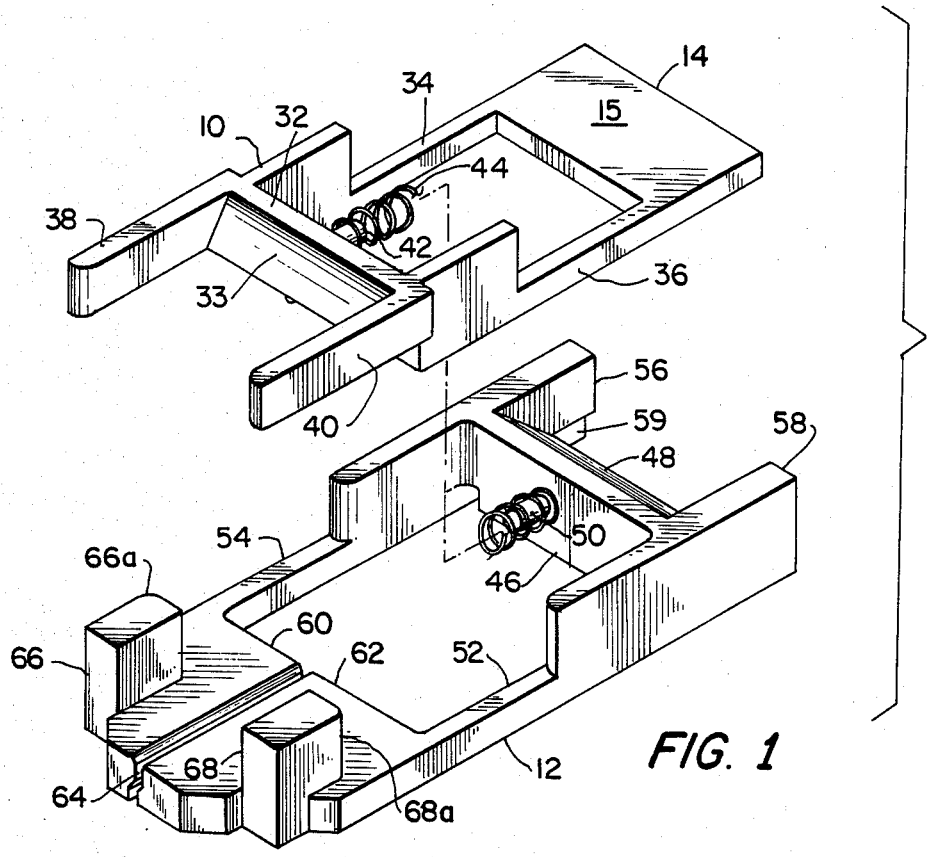
FIG. 1 is a perspective exploded view of a preferred embodiment of a shutter mechanism in accordance with the present invention.

A receptacle of the 6-20 R type is shown in FIG. 1 of U.S. Pat. No. 4,271,337, the 5-20 R configuration being the same except for the placement of the T-shaped slot on the opposite side.

Figure 9:
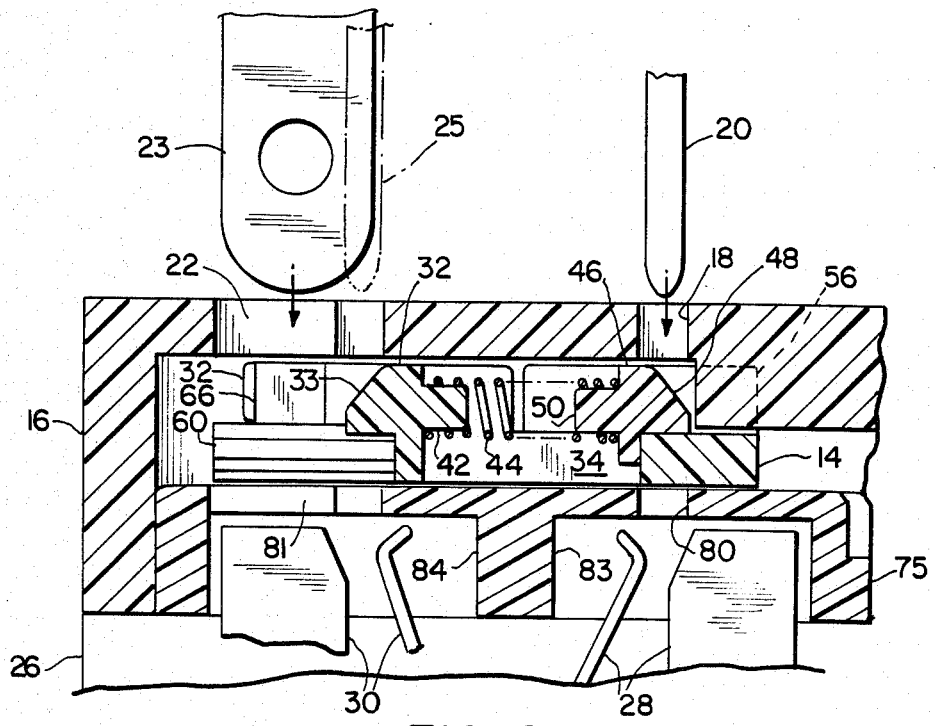
FIG. 9 is a partial side elevation, in partial section, of a receptacle containing a shutter mechanism in accordance with the invention showing the components in their normal locations in the absence of inserted plug blades.
Figure 10:
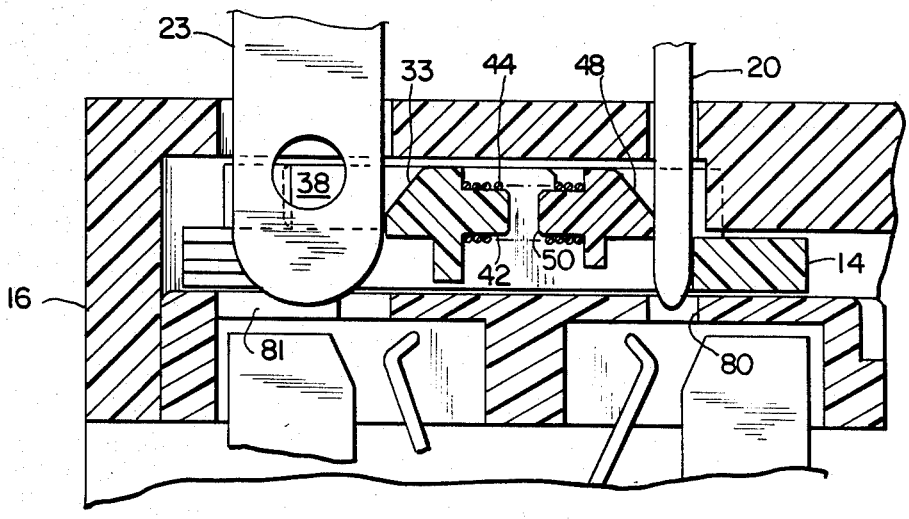
FIG. 10 is a view similar to FIG. 9 with plug blades inserted into the receptacle through the shutter mechanism.
Figure 11:
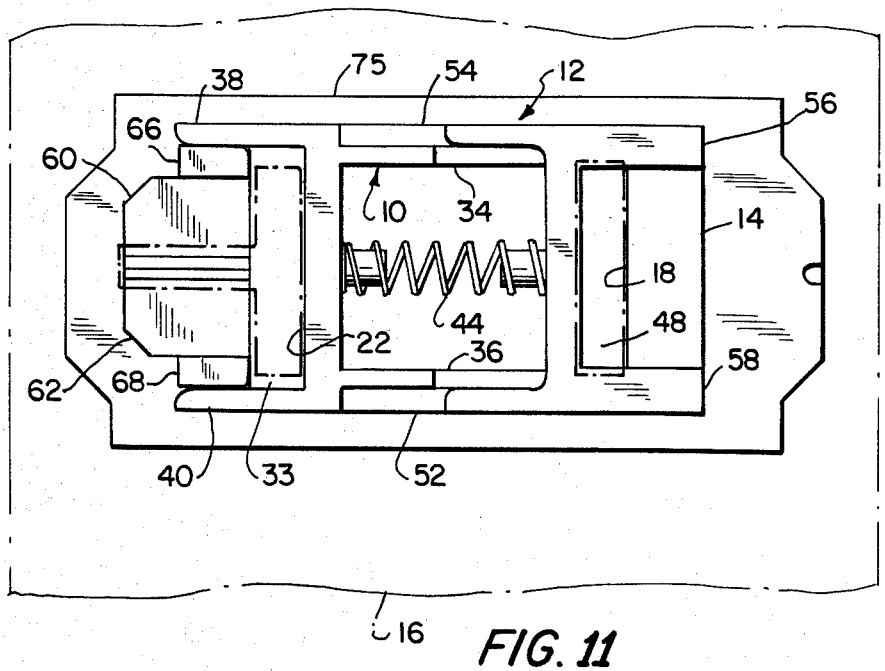
FIG. 11 is a partial top plan view of the mechanism corresponding to FIG. 9.
Figure 12:
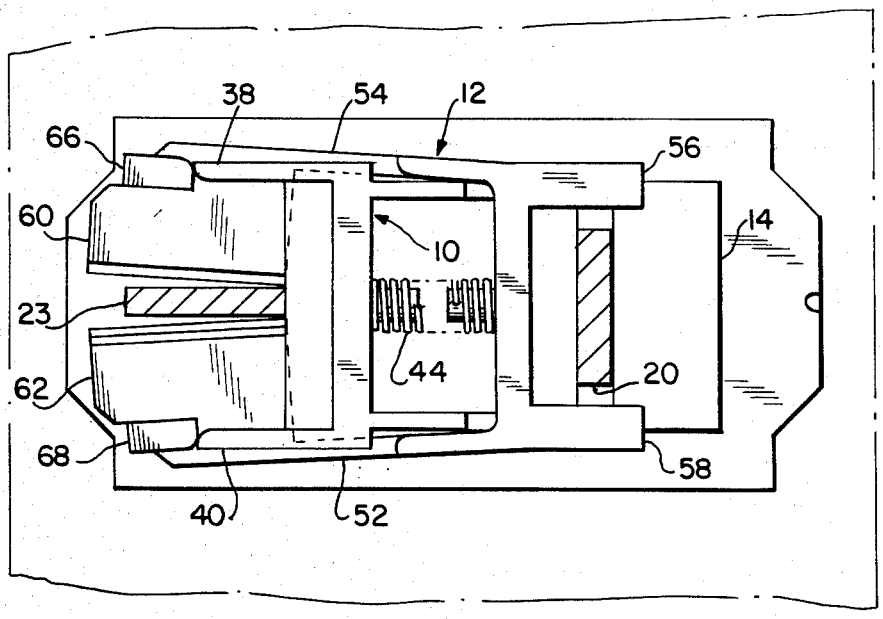
FIG. 12 is a partial top plan view of the mechanism corresponding to FIG. 10.

The overall arrangement and functioning of the apparatus of the present invention can be best understood by concurrent reference to FIGS. 1 and 9 through 12, FIG. 1 showing the basic components of the shutter mechanism and FIGS. 9–12 showing these components housed in a portion of a receptacle. In the exploded view of FIG. 1, the shutter mechanism includes a first shutter member 10 and a second shutter member 12, shutter member 10 having at one end thereof a first blocking member 14 which comprises a generally rectangular body of material having an upper surface 15 which faces toward slots in the face of the receptacle through which the plug blades can be inserted. As seen in FIGS. 9 and 11, the receptacle housing includes a cover 16 having a rectangular slot 18 therein to receive a flat blade 20 and a T-shaped slot 22 to receive a blade 23 lying in a plane perpendicular to the plane containing blade 20 or, as illustrated in dash-dot lines, a blade 25 which is parallel with blade 20. Because of the fact that other shutter mechanisms of the prior art can accommodate plugs having blades which are parallel with each other, such as blades 20 and 25, but cannot accommodate plugs having an arrangement such as blades 20 and 23, less attention will be paid to the parallel blade configuration. It is important to recognize, however, that the apparatus of the present invention can accommodate both.

Cover 16 is attached to a receptacle body 26 which is conventional in nature and which supports sets of conductive spring metal members 28 and 30, respectively, to receive and make electrical contact with blade 20 or one of blades 23 and 25, respectively. Within housing 16 is the shutter mechanism, and it will be observed that blocking body 14 lies within the housing below slot 18 and in a position to obstruct the path of blade 20.

Returning to FIG. 1, shutter member 10 also includes a body 32 which has an inclined cam surface 33 formed thereon, the surface making an angle of approximately 45° with the top surface of body 32 and facing away from member 14. Body 32 is connected to member 14 by substantially parallel side arms 34 and 36, leaving a rectangular opening between the bodies. Parallel locking arms 38 and 40 extend away from the opposite ends of body 32 and cam surface 33 in the direction in which surface 33 faces, the locking arms having inwardly facing surfaces.

It will be observed that the vertical dimension of body 14 and the adjacent portions of arms 34 and 36 is relatively small, that the remaining portions of arms 34 and 36 are taller, that member 14 and arms 34, 36 have a coplanar, flat bottom surface, and that the other end of shutter member 10 including body 32 and arms 38 and 40 is rather small in vertical dimension but is upwardly displaced from member 14. It will also be observed that a generally cylindrical guide rod 42 protrudes from the back surface of body 32 to receive an end of a compression coil spring 44 which performs the task of urging the bodies toward their normal, relaxed position with no plug blades present.

Referring again to FIGS. 9 and 11, it will be observed that body 32 and cam surface 33 lie adjacent one side of slot 22 so that a blade such as blade 23 or blade 25 will contact surface 33 upon insertion through slot 22, tending to move shutter member 10 to the right as seen in FIGS. 9 and 10. It will also be observed that the parallel locking arms, only arm 38 of which is visible in FIG. 9, extend away from surface 33 and lie on opposite sides of the outer limits of slot 22.

The second shutter member includes a second body 46 having an inclined, approximately 45°, cam surface 48 facing in the opposite direction from surface 33 when the members are assembled. A cylindrical guide rod 50 on the back surface of body 46 receives the other end of spring 44. At opposite ends of body 46 are arms 52 and 54 which extend generally parallel away from body 46 in a direction away from the facing direction of surface 48. At opposite sides of surface 48 are additional guide arms 56 and 58 which cooperate with arms 34 and 36 and member 14 of shutter member 10, arms 56 and 58 having recesses 59 at the lower edges thereof to receive the sides of shutter member 10.

Arms 52 and 54 are resilient and are provided at the ends thereof with enlargements 60 and 62 which extend toward each other and, considered together, can be regarded as forming a second blocking member. When the members are not assembled, the bodies 60 and 62 are preferably separated from each other with a gap 64 lying therebetween. When shutter member 12 is initially molded, the gap 64 is provided therein so that in the relaxed condition of arms 52 and 54, the gap is present. However, because the arms are resilient, members 60 and 62 can be pressed together to close gap 64, the marginal edges of body 60 and 62 then being in contact with each other.

Projections 66 and 68 protrude upwardly from the upper surface of body 60 and 62, respectively, these projections being positioned and dimensioned so as to fit between arms 38 and 40 when the members are assembled and in their normal positions. As will be seen in FIGS. 9 and 11, projection 66 lies inside of arm 38, the sectional view being taken through gap 64 so that the inner face of body 60 is visible.

At the other end, below slot 18, lies body 46 and cam surface 48, arm 56 being partially visible in hidden lines as it is received in a slot in cover 16 to act as a guide for the movement of the shutter member.

Figure 2:
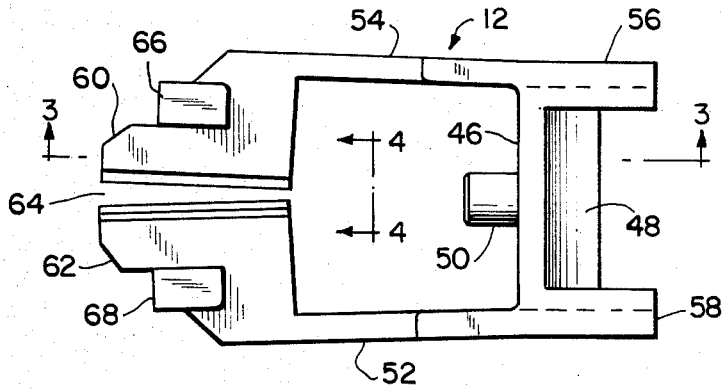
FIG. 2 is a top plan view of one shutter member of the mechanism of FIG. 1.
Figure 3:
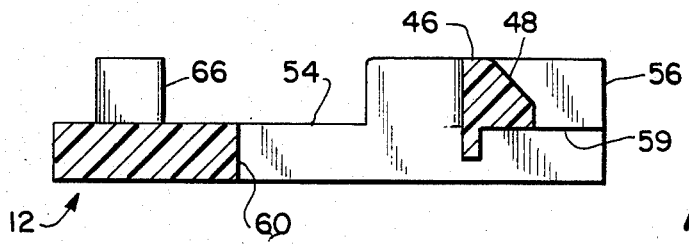
FIG. 3 is a side elevation, in section, along line 3—3 of FIG. 2.
Figure 4:
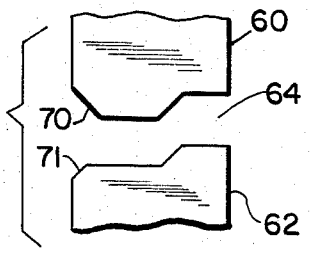
FIG. 4 is a partial sectional view along line 4—4 of FIG. 2.

Shutter member 12 is shown in plan and separate sectional views in FIGS. 2 and 3, FIG. 2 illustrating the initial position of arms 52 and 54 with bodies 60 and 62 slightly separated to form gap 64. The configuration of the gap 64 is more clearly seen in FIG. 4 wherein it will be recognized that the upper extremity of the gap, that portion which faces toward the blade-entry slot, is chamfered at 70 and 71 on body 60 and 62, respectively, to permit easy entry of the blade.

Figure 5:
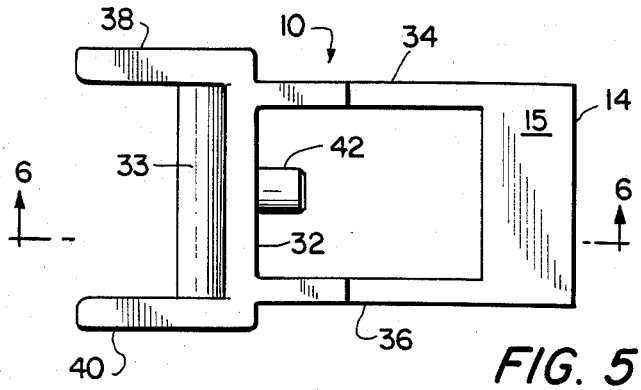
FIG. 5 is a top plan view of the other shutter member of the mechanism of FIG. 1.
Figure 6:
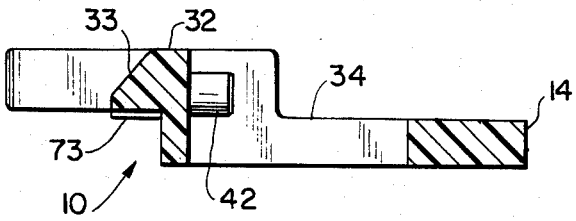
FIG. 6 is a side elevation, in section, along line 6—6 of FIG. 5.
Figure 7:
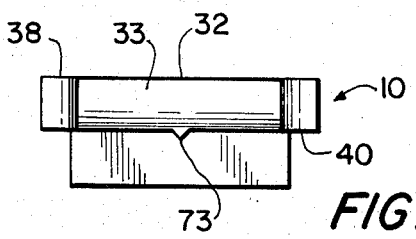
FIG. 7 is an end view of the shutter member of FIGS. 5 and 6.

In a similar fashion, shutter member 10 is shown in detail alone in FIGS. 5, 6, and 7. From FIGS. 2, 5, and 11 it will be recognized that the longitudinal dimension of member 14 is smaller than the rectangular opening between arms 52 and 54 of shutter member 12 so that the shutter members can be assembled by tilting member 10 and inserting member 14 through the opening in member 12 and then again aligning the members so that the ends of member 14 fit into the recesses 59 and arms 38 and 40 lie against the outer surfaces of projections 66 and 68. It will normally be necessary to squeeze bodies 60 and 62 together as these members are assembled. Spring 44 can then be compressed and inserted between bodies 32 and 46 and placed over guide rods 42 and 50. During assembly, spring 44 performs the additional function of holding the two shutter members together, simplifying their insertion as a unit into the receptacle.

It will also be observed that the undersurface of body 32 is provided with a small V-shaped projection 73 which fits into the notch formed by chamfered surfaces 70 and 71 and performs the primary function of preventing the insertion of a needle or other very sharp object between bodies 60 and 62 and under body 32.

Figure 8:
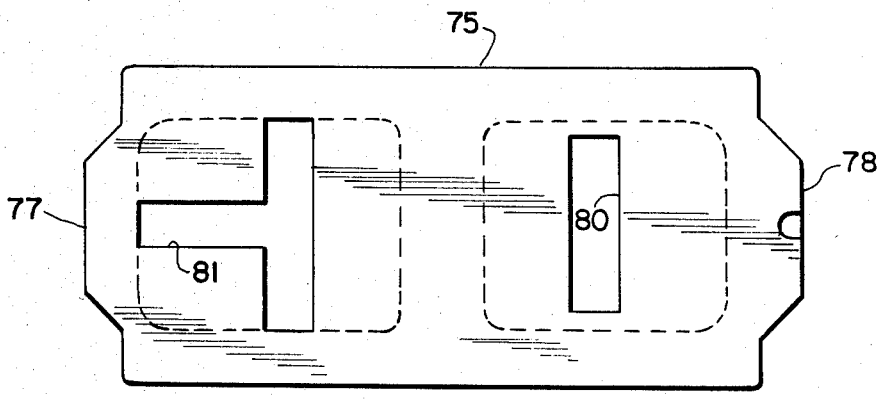
FIG. 8 is a top plan view of a support member usable with the shutter mechanism of FIG. 1.

FIG. 8 shows a base member 75 which is generally rectangular in top plan view and is provided with protrusion 77 and 78 to fit within the receptacle housing and match the interior contour thereof. Base 75 is provided with a rectangular slot 80 and a T-shaped slot 81, these slots being positioned so that, when base 75 is properly placed in the receptacle housing, slot 80 is aligned with slot 18 and slot 81 is aligned with T-shaped slot 22. As seen in FIG. 9, base 75 lies between the shutter mechanism and the conductive elements 28, 30 within the receptacle. Thus, the base member prevents the possibility of defeating the mechanism by inserting a thin conductive member at an angle, bypassing the shutter mechanism and reaching the conductive elements. In addition, the upper surface of the base member is flat and smooth, providing a good surface for the sliding action of the shutter members as a plug is inserted. As best seen in FIGS. 9 and 10, base 75 has relatively thick and sturdy side walls and is provided with interior recesses 83 and 84 to receive the upper ends of the conductive elements 28, 30 of the receptacle.

While it is believed that the functions and operation of the apparatus of the present invention will be clear from the foregoing description, a brief description of the operation is provided. As blades 20 and 23 (or 25) are inserted through slots 18 and 22, these blades contact cam surfaces 48 and 33, respectively. As blade 23 contacts cam surface 33, member 10 is caused to move to the right as viewed in FIGS. 9 and 10, carrying member 14 with surface 15 to the right so that the surface no longer obstructs the path between slots 18 and 80 for blade 20. In addition, arms 38 and 40 are extracted from their locking position against the outer surfaces of projections 66 and 68, permitting those projections to move outwardly to admit the leading end of blade 23 in slot 64. It will be observed that the distal ends of arms 38 and 40 are smoothly curved outwardly and that corners **66*a* and 68*a* of projections 66 and 68 are also curved. The primary purpose for curving corners 66*a* and 68*a* is to insure restoration of the mechanism to its normal state after blades 20, 23** are removed. The curved surfaces avoid the possibility of snagging which could result if sharp edges or corners were present.

As will be recognized, at the same time that blade 23 is moving shutter member 10 to the right, blade 20 is acting against surface 48 to move shutter member 12 to the left, cooperating with the movement of shutter 10 to extract projections 66 and 68 from the locking grip of arms 38 and 40. Additionally, this action moves the rectangular opening in the center of shutter member 12 to a position below the cross portion of the T-shaped slot 22 so that a blade 25, if present, can pass through to the similar portion of slot 81. As will be recognized, this does not require any separation of gap 64. However, if the blade 23 is present, it must pass through gap 64 in order to enter slot 81. During the insertion of the plug blades, guide rods 42 and 50 move toward each other, compressing spring 44, and upon removal of the blades, spring 44 returns the members to their original position. As will be seen in FIG. 9, the extent of movement of guide rods 42 and 50 away from each other is limited by the abutment of a downwardly extending portion of body 32 against the inner surfaces of members 60 and 62.

It will be readily apparent that the insertion of a single blade-like article into slot 18 may move shutter member 12 to the left but will not permit the article to reach conductive elements 28 because blocking member 14 is still in the way. Similarly, insertion of an article into slot 22 may or may not move shutter member 10 to the right but further insertion of the article is prevented by bodies 60 and 62. Even a single blade-like article oriented like blade 23 cannot pass because both of members 10 and 12 must be moved to remove projections 66 and 68 from the locking grip of arms 38 and 40.

Shutter members 10 and 12 and base member 75 can all be manufactured by conventional injection molding techniques using any of several conventional thermoplastic polymeric materials.

The presence or absence of a grounding plug is not particularly relevant to the structure of the present invention and is therefore not illustrated. It should be mentioned, however, that the shutter mechanism shown and described does not interfere in any way with the presence of such a grounding plug, and it would be expected to be present in all blade configurations.

While one advantageous embodiment has been chosen to illustrate the invention, it will be understood by those skilled in the art that various changes and modifications can be made therein without departing from the scope of the invention as defined in the appended claims.

What I claim is:

1. A shutter mechanism for use in a receptacle of the type having a faceplate with slots therethrough shaped and dimensioned to permit the passage of plug blades wherein one blade lies in a first plane and a second blade lies in one of two orthogonal planes, the mechanism comprising the combination of first and second relatively movable shutter members;

spring means for urging each of said shutter members toward a normal location in the absence of inserted plug blades;

said first shutter member including a first blocking member having a surface lying in a position to block the path of a blade in said first plane in said normal location;

a first body having a first inclined cam surface lying in the path of a blade lying in one of said two orthogonal planes, said cam surface facing away from said first member;

means for substantially rigidly interconnecting said first blocking member and said first body: and means defining first and second substantially parallel, inwardly facing surfaces generally aligned with the opposite ends of said first cam surface;

said second shutter member including a second body having a second cam surface lying in the path of a blade lying in either of two orthogonal planes in its normal location and in front of the blocking surface of said first member;

third and fourth bodies extending toward each other to together form a second blocking member lying partly behind said first cam surface and in a position to block the path of a blade lying in either of said orthogonal planes, said third and fourth bodies meeting along a line contained in one of said orthogonal planes;

means for resiliently supporting said third and fourth bodies for movement with said second body;

third and fourth projections extending away from said third and fourth bodies and between said first and second parallel, inwardly facing surfaces to hold said third and fourth bodies together in said normal location;

said first and second cam surfaces being contactable by the concurrent entry of plug blades to move said shutter members so that said first and second blocking members move away from the paths of blades lying in parallel planes, said first and second parallel surfaces being positioned so that said third and fourth projections are released by said surfaces when the inserted blades approach said blocking members, thereby permitting said third and fourth bodies to separate and admit a perpendicular blade therebetween.

2. A mechanism according to claim 1, wherein said first shuuter member includes first and second parallel arms extending away from opposite ends of said first cam surface, the inner surfaces of said arms comprising said means defining said first and second inwardly facing surfaces.

3. A mechanism according to claim 1, wherein said means for resiliently supporting said third and fourth bodies includes third and fourth resilient, generally parallel arms extending away from opposite ends of said second body in a direction opposite the facing direction of said second cam surface, said third and fourth bodies being mounted at the distal ends of said arms.

4. A mechanism according to claim 1, wherein said means for substantially rigidly interconnecting said first blocking member and said first body comprises fifth and sixth generally parallel arms extending between the ends of said bodies.

5. A mechanism according to claim 4, wherein said third and fourth arms are generally parallel with and lie laterally outside of said fifth and sixth arms.

6. A mechanism according to claim 1 and further including a base member having slots shaped and dimensioned to match the slots in said faceplate, said base member being mountable in said receptacle with said slots aligned and with said shutter members between said base member and said faceplate.

7. A mechanism according to claim 6, wherein said spring means comprises a compression coil spring, and said first and second bodies each includes a projection extending toward the other of said bodies to receive an end of said spring.

8. A mechanism according to claim 7, wherein said means for substantially rigidly interconnecting said first blocking member and said first body comprises fifth and sixth generally parallel arms extending between the ends of said bodies.

9. A mechanism according to claim 7, wherein said means for resiliently supporting said third and fourth bodies includes third and fourth resilient, generally parallel arms extending away from opposite ends of said second body in a direction opposite the facing direction of said second cam surface, said third and fourth bodies being mounted at the distal ends of said arms.

10. A mechanism according to claim 7, wherein said first shutter member includes first and second parallel arms extending away from opposite ends of said first cam surface, the inner surfaces of said arms comprising said means defining said first and second inwardly facing surfaces.

11. A mechanism according to claim 7, wherein each of said third and fourth bodies includes a chamfered edge adjacent the line along which said bodies meet.

12. A mechanism according to claim 11, wherein said means for substantially rigidly interconnecting said first blocking member and said first body comprises fifth and sixth generally parallel arms extending between the ends of said bodies.

13. A mechanism according to claim 11, wherein said means for resiliently supporting said third and fourth bodies includes third and fourth resilient, generally parallel arms extending away from opposite ends of said second body in a direction opposite the facing direction of said second cam surface, said third and fourth bodies being mounted at the distal ends of said arms.

14. A mechanism according to claim 11, wherein said first shutter member includes first and second parallel arms extending away from opposite ends of said first cam surface, the inner surfaces of said arms comprising said means defining said first and second inwardly facing surfaces.

15. A mechanism according to claim 14, wherein the movements of said shutter members are linear and coplanar and said cam surfaces each forms an angle of about 45° with the plane of movement.

16. A mechanism according to claim 14, wherein said means for substantially rigidly interconnecting said first blocking member and said first body comprises fifth and sixth generally parallel arms extending between the ends of said bodies.

17. A mechanism according to claim 14, wherein said means for resiliently supporting said third and fourth bodies includes third and fourth resilient, generally parallel arms extending away from opposite ends of said second body in a direction opposite the facing direction of said second cam surface, said third and fourth bodies being mounted at the distal ends of said arms.

18. A mechanism according to claim 17, wherein said means for substantially rigidly interrconnecting said first blocking member and said first body comprises fifth and sixth generally parallel arms extending between the ends of said bodies.

19. A mechanism according to claim 18, wherein said third and fourth arms are generally parallel with and lie laterally outside of said fifth and sixth arms.

20. A mechanism according to claim 19, wherein the movements of said shutter members are linear and coplanar and said cam surfaces each form an angle of about 45° with the plane of movement.

* * * * *